US011663960B2

(12) United States Patent
Hashimoto

(10) Patent No.: US 11,663,960 B2
(45) Date of Patent: May 30, 2023

(54) ELECTRONIC DEVICE

(71) Applicant: Innolux Corporation, Miao-Li County (TW)

(72) Inventor: Kazuyuki Hashimoto, Miao-Li County (TW)

(73) Assignee: Innolux Corporation, Miaoli County (TW)

( * ) Notice: Subject to any disclaimer, the term of this patent is extended or adjusted under 35 U.S.C. 154(b) by 0 days.

(21) Appl. No.: 17/732,559

(22) Filed: Apr. 29, 2022

(65) Prior Publication Data

US 2023/0057215 A1 Feb. 23, 2023

Related U.S. Application Data

(60) Provisional application No. 63/234,717, filed on Aug. 19, 2021.

(51) Int. Cl.
*G09G 3/32* (2016.01)

(52) U.S. Cl.
CPC ..... *G09G 3/32* (2013.01); *G09G 2310/027* (2013.01); *G09G 2320/064* (2013.01); *G09G 2320/0633* (2013.01); *G09G 2320/0673* (2013.01)

(58) Field of Classification Search
CPC ..... G09G 3/32; G09G 2310/027; G09G 2320/0633; G09G 2320/064; G09G 2320/0673
See application file for complete search history.

(56) References Cited

U.S. PATENT DOCUMENTS 7,119,773 B2 * 10/2006 Kim ..... G09G 3/3233 345/63
7,652,644 B2 * 1/2010 Lee ..... G09G 3/22 345/76
8,259,039 B2 * 9/2012 Abe ..... G09G 3/22 345/76
8,624,834 B2 * 1/2014 Kim ..... G09G 3/34 345/107
8,797,346 B2 * 8/2014 Park ..... G06T 5/001 348/739
10,395,596 B2 * 8/2019 Jang ..... G09G 3/3266
10,504,406 B2 * 12/2019 Shigeta ..... G09G 3/2081
10,593,251 B2 * 3/2020 Shigeta ..... G09G 3/2018
10,706,766 B2 * 7/2020 Kim ..... H01L 25/167
10,713,996 B2 * 7/2020 Kim ..... H01L 27/156
10,825,380 B2 * 11/2020 Kim ..... H01L 25/0753
10,832,615 B2 * 11/2020 Kim ..... G09G 3/2003
11,100,840 B2 * 8/2021 Kim ..... G09G 3/2014
(Continued)

FOREIGN PATENT DOCUMENTS

TW 202131758 8/2021

*Primary Examiner* — Michael J Jansen, II
(74) *Attorney, Agent, or Firm* — JCIPRNET

(57) ABSTRACT

An electronic device is provided. The electronic device includes a driver, a driving circuit and an electronic element. The driver converts a first PWM data to a second PWM data according to a gamma setting curve, and converts a first PAM data to a second PAM data according to the gamma setting curve. The driving circuit includes a PWM circuit and a PAM circuit. The PWM circuit receives the second PWM data. The PAM circuit receives the second PAM data. The electronic element emits a light according to a driving current provided from the driving circuit.

17 Claims, 8 Drawing Sheets

(56) References Cited

U.S. PATENT DOCUMENTS

| | | | | |
|---|---|---|---|---|
| 11,210,995 | B2 * | 12/2021 | Kim | G09G 3/32 |
| 11,398,181 | B2 * | 7/2022 | Kim | G09G 3/2014 |
| 11,495,171 | B2 * | 11/2022 | Kim | G09G 3/32 |
| 11,551,606 | B2 * | 1/2023 | Kim | G09G 3/3233 |
| 2001/0019319 | A1 * | 9/2001 | Kim | G09G 3/3233 345/77 |
| 2005/0200319 | A1 * | 9/2005 | Yamano | G09G 3/22 315/382.1 |
| 2006/0114189 | A1 * | 6/2006 | Lee | G09G 3/22 345/75.2 |
| 2010/0091049 | A1 * | 4/2010 | Kim | G09G 3/2081 345/213 |
| 2011/0122110 | A1 * | 5/2011 | Abe | G09G 3/22 345/207 |
| 2013/0120659 | A1 * | 5/2013 | Park | H04N 5/202 348/E5.074 |
| 2018/0182298 | A1 * | 6/2018 | Jang | G09G 3/3291 |
| 2018/0293929 | A1 * | 10/2018 | Shigeta | G09G 3/3233 |
| 2018/0301080 | A1 * | 10/2018 | Shigeta | G09G 3/32 |
| 2019/0371231 | A1 * | 12/2019 | Kim | G09G 3/2081 |
| 2019/0371232 | A1 * | 12/2019 | Kim | H01L 25/0753 |
| 2020/0111403 | A1 * | 4/2020 | Kim | G09G 3/32 |
| 2020/0111404 | A1 * | 4/2020 | Kim | G09G 3/2014 |
| 2020/0312216 | A1 * | 10/2020 | Kim | G09G 3/2081 |
| 2020/0312229 | A1 * | 10/2020 | Kim | G09G 3/32 |
| 2020/0394953 | A1 * | 12/2020 | Kim | H05B 45/325 |
| 2021/0210003 | A1 * | 7/2021 | Kim | G09G 3/32 |
| 2022/0199001 | A1 * | 6/2022 | Kim | G09G 3/3233 |
| 2022/0301500 | A1 * | 9/2022 | Shigeta | G09G 3/20 |
| 2023/0057215 | A1 * | 2/2023 | Hashimoto | G09G 3/32 |

* cited by examiner

ELECTRONIC DEVICE

CROSS-REFERENCE TO RELATED APPLICATION

This application claims the priority benefit of U.S. Provisional application Ser. No. 63/234,717, filed on Aug. 19, 2021. The entirety of the above-mentioned patent application is hereby incorporated by reference herein and made a part of this specification.

BACKGROUND

Technical Field

The disclosure generally relates to an electronic device, and more particularly to an electronic device having a PWM circuit and a PAM circuit.

Description of Related Art

Generally, an electronic device converts digital data to analog voltage (e.g. gamma setting) using a source driver IC. The source driver IC provides one or more independent gamma setting for pulse amplitude modulation (PAM). In order to improve optical performance of the electronic device, if the electronic device needs independent gamma setting for PAM and other pulse modulation, two source driver ICs must be required. Two source driver ICs causes cost up.

SUMMARY

The disclosure is related to an electronic device having gamma setting for pulse amplitude modulation (PAM) and pulse width modulation (PWM).

The disclosure provides an electronic device. The electronic device includes a driver, a driving circuit and an electronic element. The driver converts a first PWM data to a second PWM data according to a gamma setting curve, and converts a first PAM data to a second PAM data according to the gamma setting curve. The driving circuit is electrically connected to the driver. The driving circuit includes a PWM circuit and a PAM circuit. The PWM circuit receives the second PWM data. The PAM circuit receives the second PAM data. The electronic element is electrically connected to the driving circuit. The electronic element emits a light according to a driving current provided from the driving circuit.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
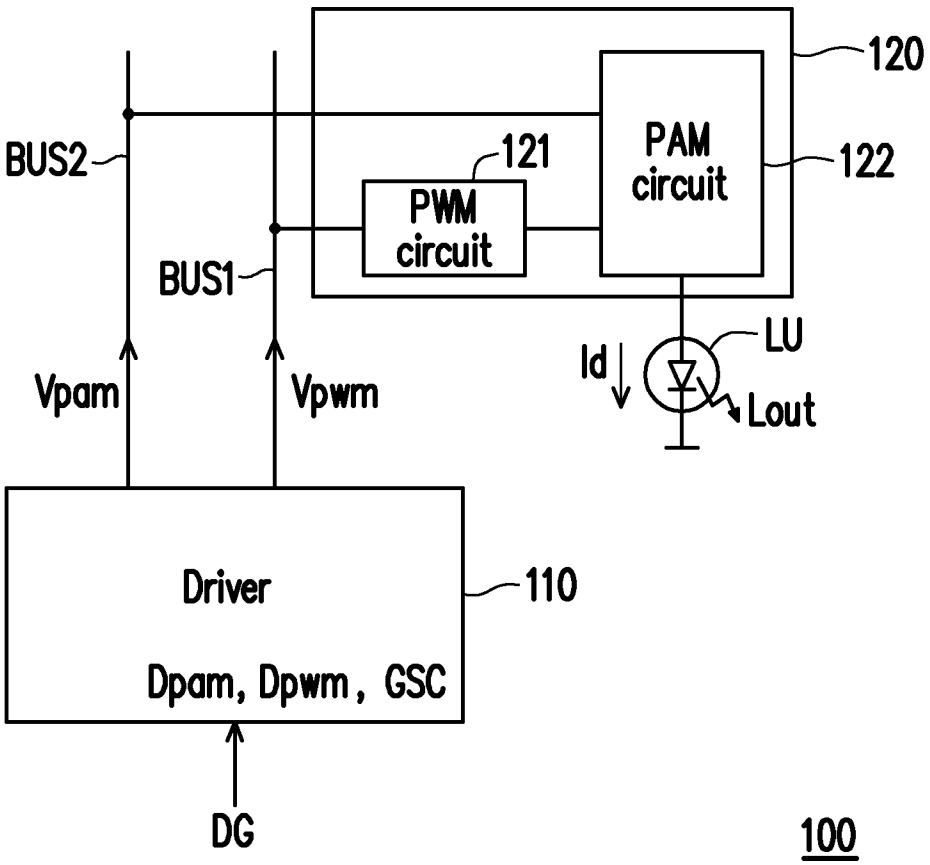
FIG. 1 illustrates a schematic diagram of an electronic device according to a first embodiment of the disclosure.

A disclosure may be understood by reference to the following detailed description, taken in conjunction with the drawings as described below. It is noted that, for purposes of illustrative clarity and being easily understood by the readers, various drawings of this disclosure show a portion of an electronic device, and certain elements in various drawings may not be drawn to scale. In addition, the number and dimension of each device shown in drawings are only illustrative and are not intended to limit the scope of a disclosure.

Certain terms are used throughout the description and following claims to refer to particular components. As one skilled in the art will understand, electronic equipment manufacturers may refer to a component by different names. This document does not intend to distinguish between components that differ in name but not function. In the following description and in the claims, the terms "include", "comprise" and "have" are used in an open-ended fashion, and thus should be interpreted to mean "include, but not limited to . . . ". Thus, when the terms "include", "comprise" and/or "have" are used in the description of a disclosure, the corresponding features, areas, steps, operations and/or components would be pointed to existence, but not limited to the existence of one or a plurality of the corresponding features, areas, steps, operations and/or components.

It will be understood that when an element is referred to as being "coupled to", "connected to", or "conducted to" another element, it may be directly connected to the other element and established directly electrical connection, or intervening elements may be presented therebetween for relaying electrical connection (indirectly electrical connection). In contrast, when an element is referred to as being "directly coupled to", "directly conducted to", or "directly connected to" another element, there are no intervening elements presented.

Although terms such as first, second, third, etc., may be used to describe diverse constituent elements, such constituent elements are not limited by the terms. The terms are used only to discriminate a constituent element from other constituent elements in the specification. The claims may not use the same terms, but instead may use the terms first, second, third, etc. with respect to the order in which an element is claimed. Accordingly, in the following description, a first constituent element may be a second constituent element in a claim.

In a disclosure, the embodiments use "pixel" or "pixel unit" as a unit for describing a specific region including at least one functional circuit for at least one specific function. Describing "pixel with circuit" as "circuit" is available for a disclosure. For example, a "pixel with current source" may be described as a "current source", or a "pixel with current sink" may be described as a "current sink". The region of a "pixel" is depended on a unit for providing a specific function, adjacent pixels may share the same parts or wires, but may also include its own specific parts therein. For example, adjacent pixels may share a same scan line or a same data line, but the pixels may also have their own transistors or capacitance.

In a disclosure, a current source circuit is a circuit unit for outputting current, and a current sink is a circuit unit for draining current. The adjacent circuit units may share the same parts or wires and may also include its specific parts therein.

It should be noted that the technical features in different embodiments described in the following can be replaced, recombined, or mixed with one another to constitute another embodiment without departing from the spirit of a disclosure.

FIG. 1 illustrates a schematic diagram of an electronic device according to a first embodiment of the disclosure. Referring to FIG. 1, the electronic device 100 includes a driver 110, a driving circuit 120 and an electronic element LU. In the embodiment, the driver 110 converts a first PWM data Dpwm to a second PWM data Vpwm according to a gamma setting curve GSC. The driver 110 converts a first PAM data Dpam to a second PAM data Vpam according to the gamma setting curve GSC. In the embodiment, the driver 110 receives a gray scale data DG. The driver 110 generates the first PWM data Dpwm and the first PAM data Dpam according to the gray scale data DG. In the embodiment, the gray scale data DG has a digital gray value.

In the embodiment, the driving circuit 120 is electrically connected to the driver 110. The driving circuit 120 includes a PWM circuit 121 and a PAM circuit 122. The PWM circuit 121 receives the second PWM data Vpwm from the driver 110. The PAM circuit 122 receives the second PAM data Vpam from the driver 110. In the embodiment, the driving circuit 120 provides a driving current Id in response to the second PWM data Vpwm and the second PAM data Vpam. The electronic element LU is electrically connected to the driving circuit 120. The electronic element LU can be a light emitting element, and the electronic element LU can emit a light Lout according to the driving current Id provided from the driving circuit 120.

According to some embodiments, the driver 110 converts the first PWM data Dpwm to the second PWM data Vpwm and converts the first PAM data Dpam to the second PAM data Vpam according to a gamma setting curve GSC. The electronic device 100 has a hybrid gamma setting for PAM and PWM based on one driver 110. Therefore, the optical performance of the electronic device 100 can be improved by the hybrid gamma setting for PAM and PWM without significantly increasing cost.

Referring to FIG. 1 in the embodiment, the driving circuit 120 is electrically connected to the driver 110 via two separate data buses BUS1 and BUS2. The data bus BUS1 is connected to the driver 110 and the PWM circuit 121. The second PWM data Vpwm is transmitted from the driver 110 to the PWM circuit 121 via the data bus BUS1. The data bus BUS2 is connected to the driver 110 and the PAM circuit 122. The second PAM data Vpam is transmitted from the driver 110 to the PAM circuit 122 via the data bus BUS2.

In the embodiment, the electronic device 100 is a light emitting device, but not be limited thereto. For example, the electronic device 100 may be a non-light emitting device, or a display device. The driving circuit can be a pixel circuit for the display device, but not be limited thereto. The driver 110 may be implemented by a conversion circuit, a source driving circuit, a data driving circuit, or a combination of the above circuits. The electronic element LU may be a light emitting element. For example, the electronic element LU may be at least one organic light emitting diode display device (OLED), inorganic light emitting diode (LED), minimeter-sized light emitting diode (mini-LED), micrometer-sized light emitting diode (micro-LED), quantum dot light emitting diode (QLED), but not be limited thereto.

Figure 2:
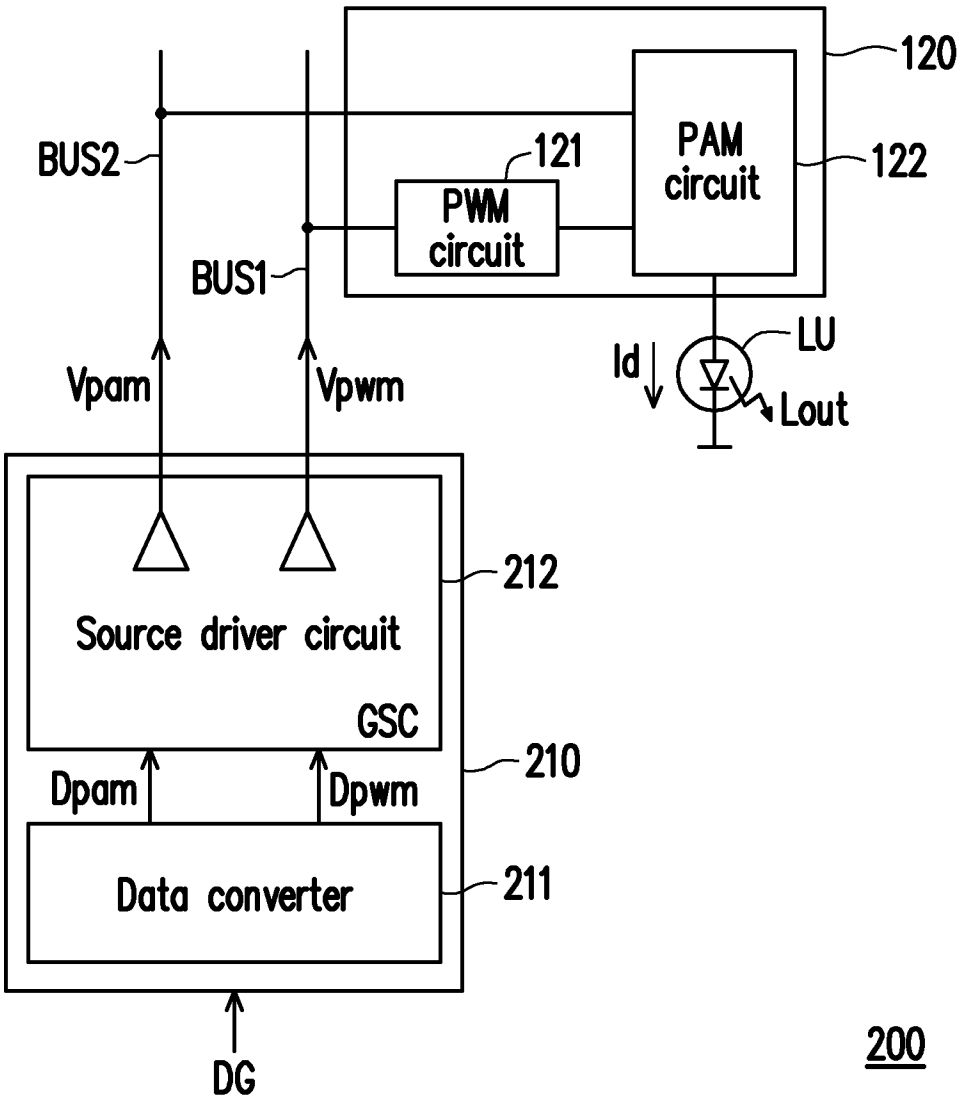
FIG. 2 illustrates a schematic diagram of an electronic device according to a second embodiment of the disclosure.

FIG. 2 illustrates a schematic diagram of an electronic device according to a second embodiment of the disclosure. Referring to FIG. 2, the electronic device 200 includes a driver 210, the driving circuit 120 and the electronic element LU. In the embodiment, the driver 210 includes a data converter 211 and source driver circuit 212. The data converter 211 is configured to receive the gray scale data DG, and to convert the gray scale data DG to the first PWM data Dpwm and the first PAM data Dpam. The source driver circuit 212 is electrically connected to the data converter 211. The source driver circuit 212 is configured to receive the first PWM data Dpwm and the first PAM data Dpam from the data converter 211. The source driver circuit 212 is configured to convert the first PWM data Dpwm to the second PWM data Vpwm according to the gamma setting curve GSC, and to convert the first PAM data Dpam to the second PAM data Vpam according to the gamma setting curve GSC. In some embodiments, the electronic element LU can be light emitting element, and the electronic device 200 can be a light emitting device.

Operations of the driving circuit 120 and the electronic element LU have been clearly explained in the embodiment of FIG. 1. Therefore, the description of the operations of the driving circuit 120 and the electronic element LU will not be repeated here.

In the embodiment, the data converter 211 includes at least one of a field programmable gate array (FPGA) circuit or LUT, but not be limited thereto. For example, the data converter 211 may convert the gray scale data DG to the first PWM data Dpwm and the first PAM data Dpam by LUT. In the embodiment, the source driver circuit 212 includes a digital to analog converter (DAC), but not be limited thereto. For example, the source driver circuit 212 may convert the first PWM data Dpwm to the second PWM data Vpwm by the DAC, and convert the first PAM data Dpam to the second PAM data Vpam by the DAC.

Figure 3:
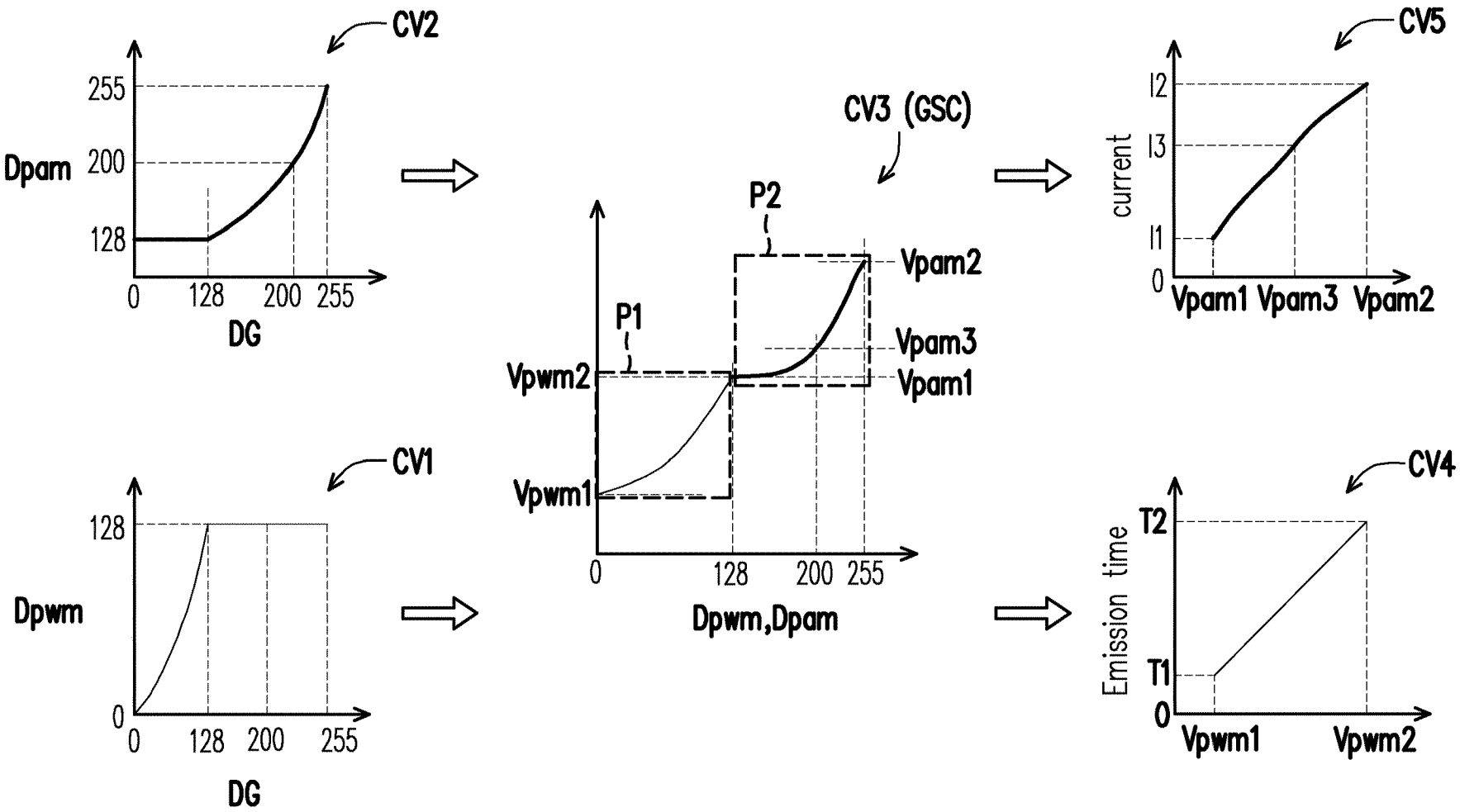
FIG. 3 illustrates a schematic diagram of an operation according to FIG. 2.

FIG. 3 illustrates a schematic diagram of an operation according to FIG. 2. Referring to FIGS. 2 and 3, FIG. 3 illustrates conversion curves CV1, CV2, CV3, CV4 and CV5. The conversion curve CV1 shows a converting relationship between the gray scale data DG and the first PWM data Dpwm. The conversion curve CV2 shows a converting relationship between the gray scale data DG and the first PAM data Dpam.

Based on the conversion curve CV1, when the gray scale data DG is lower than a specified gray level, a digital value of the first PWM data Dpwm is increased as the gray scale data DG increases. When the gray scale data DG is higher than or equal to the specified gray level, the digital value of the first PWM data Dpwm is fixed as a maximum digital value. For example, the specified gray level is set as "128". When the gray scale data DG is lower than the specified gray level (128), a digital value of the first PWM data Dpwm is increased as the gray scale data DG increases. When the gray scale data DG is higher than or equal to 128, a digital value of the first PWM data Dpwm is fixed as "128".

Based on the conversion curve CV2, when the gray scale data DG is lower than the specified gray level, a digital value of the first PAM data Dpam is fixed as a minimum digital value. For example, the specified gray level is set as "128". When the gray scale data DG is lower than the specified gray level, a digital value of the first PAM data Dpam is fixed as "128". When the gray scale data DG is higher than or equal to the specified gray level, the digital value of the first PWM data Dpwm is increased as the gray scale data DG increases.

The data converter 211 receives the gray scale data DG, converts the gray scale data DG to the first PWM data Dpwm according to the conversion curve CV1, and converts the gray scale data DG to the first PAM data Dpam according to the conversion curve CV2.

In some embodiments, the conversion curve CV1 is used as a first look-up table (LUT). The conversion curve CV2 is used as a second LUT. Therefore, the data converter 211 may convert the gray scale data DG to the first PWM data Dpwm according to a first look-up table (LUT) and convert the gray scale data DG to the first PAM data Dpam according to a second LUT.

Referring to FIG. 3, in the embodiment, the conversion curve CV3 is the gamma setting curve GSC. The gamma setting curve GSC shows a converting relationship between the first PWM data Dpwm, the second PWM data Vpwm, the first PAM data Dpam and the second PAM data Vpam. The gamma setting curve GSC includes a first part P1 and a second part P2. The first part P1 and the second part P2 of the gamma setting curve GSC are not overlapped. In the embodiment, the first part P1 is a gamma setting curve between the first PWM data Dpwm and the second PWM data Vpwm. The second part P2 is a gamma setting curve between the first PAM data Dpam and the second PAM data Vpam.

In the embodiment, the first part P1 shows a converting relationship between the first PWM data Dpwm and the second PWM data Vpwm. The source driver circuit 212 converts the first PWM data Dpwm to the second PWM data Vpwm according to the first part P1. In the embodiment, the first PWM data Dpwm is a PWM digital data. The second PWM data Vpwm is a PWM analog data. Further, the PWM analog data is a first control voltage outputted to the PWM circuit 121 for controlling a width of the driving current Id.

The first part P2 shows a converting relationship between the first PAM data Dpam and the second PAM data Vpam. The source driver circuit 212 converts the first PAM data Dpam to the second PAM data Vpam according to the first part P2. In the embodiment, the first PAM data Dpam is a PAM digital data. The second PAM data Vpam is a PAM analog data. Further, the PAM analog data is a second control voltage outputted to the PAM circuit for controlling an amplitude of the driving current Id.

Referring to FIG. 3, for example, when the gray scale data DG is "0", the digital value of the first PWM data Dpwm is "0" and the digital value of the first PAM data Dpam is fixed as "128". The source driver circuit 212 may provide a second PWM data Vpwm1 and a second PAM data Vpam1. When the gray scale data DG is "128", the digital value of the first PWM data Dpwm is "128" and the digital value of the first PAM data Dpam is fixed as "128". The source driver circuit 212 may provide a second PWM data Vpwm2 and a second PAM data Vpam1. When the gray scale data DG is "200", the digital value of the first PWM data Dpwm is fixed as "128" and the digital value of the first PAM data Dpam is "200". The source driver circuit 212 may provide a second PWM data Vpwm2 and a second PAM data Vpam3. When the gray scale data DG is "255", When the digital value of the first PWM data Dpwm is fixed as "128" and the digital value of the first PAM data Dpam is "255", the source driver circuit 212 may provide a second PWM data Vpwm2 and a second PAM data Vpam2.

In the embodiment, the conversion curve CV4 shows a converting relationship between the second PWM data Vpwm and an emission time. The emission time is associated with the width and/or a duty cycle of the driving current Id. The PWM circuit 121 controls the width of the driving current Id according to the second PWM data Vpwm (that is, the PWM analog data) based on the conversion curve CV4. In the embodiment, the conversion curve CV5 shows a converting relationship between the second PAM data Vpam and the amplitude of the driving current Id. The amplitude of the driving current Id is a current value of the driving current Id. The PAM circuit 122 controls the amplitude of the driving current Id according to the second PAM data Vpam (that is, the PAM analog data) based on the conversion curve CV5.

For example, the PWM circuit 121 provides an emission time T1 according the second PWM data Vpwm1 and provides an emission time T2 according the second PWM data Vpwm2. The PAM circuit 122 provides a current value I1 of the driving current Id according the second PAM data Vpam1, provides a current value I2 of the driving current Id according the second PAM data Vpam2, and provides a current value I3 of the driving current Id according the second PAM data Vpam3.

In the embodiment, the PWM circuit 121 is electrically connected the PAM circuit 122. The PAM circuit 122 is electrically connected to the electronic element LU. For example, the PAM circuit 122 includes a driving transistor (not shown). A first terminal of the driving transistor is used to receive the driving current Id. A second terminal of the driving transistor is electrically connected to the electronic element LU. A control terminal of the driving transistor is electrically connected to the PWM circuit 121. The control terminal of the driving transistor the first control voltage is used to receive the first control voltage associated with the emission time.

Based on the conversion curves CV1, CV2, CV3, CV4 and CV5, when the gray scale data DG is lower than the specified gray level, an operation of the electronic element LU is adjusted by the emission time. Besides, when the gray scale data DG is lower than the specified gray level, the driving current Id provided from the driving circuit 120 is fixed. When the gray scale data DG is higher than or equal to the specified gray level, the operation of the electronic element LU is adjusted by the driving current Id. Besides, when the gray scale data DG is higher than or equal to the specified gray level, the emission time is fixed.

In some embodiments, the gamma setting curve GSC may by designed in different forms.

Figure 4:
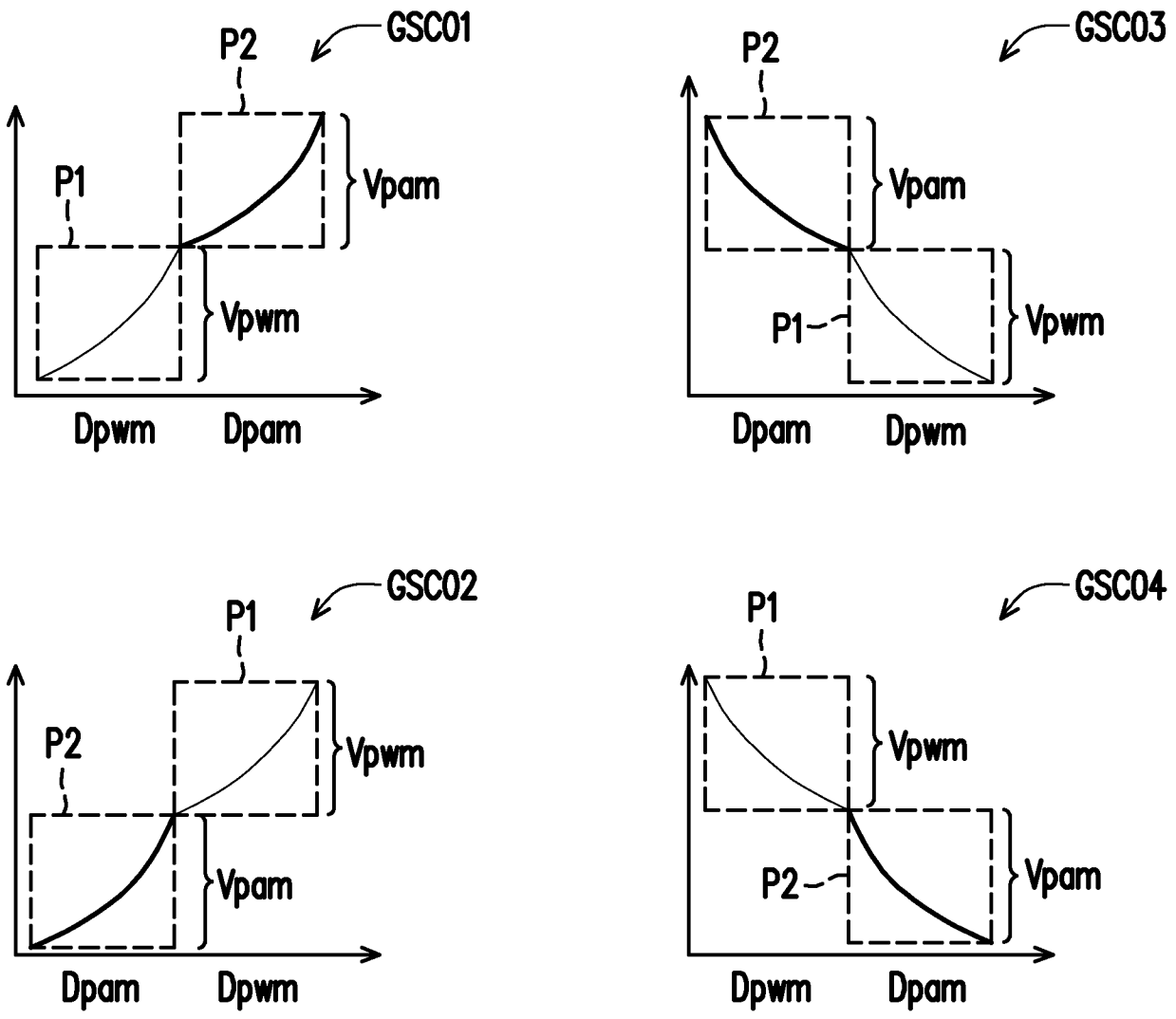
FIG. 4 illustrates gamma setting curves according to an embodiment of the disclosure.

FIG. 4 illustrates gamma setting curves according to an embodiment of the disclosure. Referring to FIG. 4, FIG. 4 shows gamma setting curves GSC01, GSC02, GSC03 and GSC04. Each of the gamma setting curves GSC01, GSC02, GSC03 and GSC04 includes a first part P1 and a second part P2. The first part P1 is between the first PWM data Dpwm and the second PWM data Vpwm, the second part P2 is between the first PAM data Dpam and the second PAM data Vpam. In this embodiment, the first part P1 and the second part P2 of the gamma setting curve GSC are not overlapped.

In the gamma setting curves GSC01, a minimum of the second PAM data Vpam is equal to or higher than a maximum of the second PWM data Vpwm. Besides, the second PWM data Vpwm is positively correlated with the first PWM data Dpwm, and the second PAM data Vpam is positively correlated with the first PAM data Dpam.

In the gamma setting curves GSC02, a minimum of the second PWM data Vpwm is equal to or higher than a maximum of the second PAM data Vpam. Besides, the second PWM data Vpwm is positively correlated with the first PWM data Dpwm, and the second PAM data Vpam is positively correlated with the first PAM data Dpam.

In the gamma setting curves GSC03, a minimum of the second PAM data Vpam is equal to or higher than a maximum of the second PWM data Vpwm. Besides, the second PWM data Vpwm is negatively correlated with the first PWM data Dpwm, and the second PAM data Vpam is negatively correlated with the first PAM data Dpam.

In the gamma setting curves GSC04, a minimum of the second PWM data Vpwm is equal to or higher than a maximum of the second PAM data Vpam. Besides, the second PWM data Vpwm is negatively correlated with the first PWM data Dpwm, and the second PAM data Vpam is negatively correlated with the first PAM data Dpam.

Figure 5:
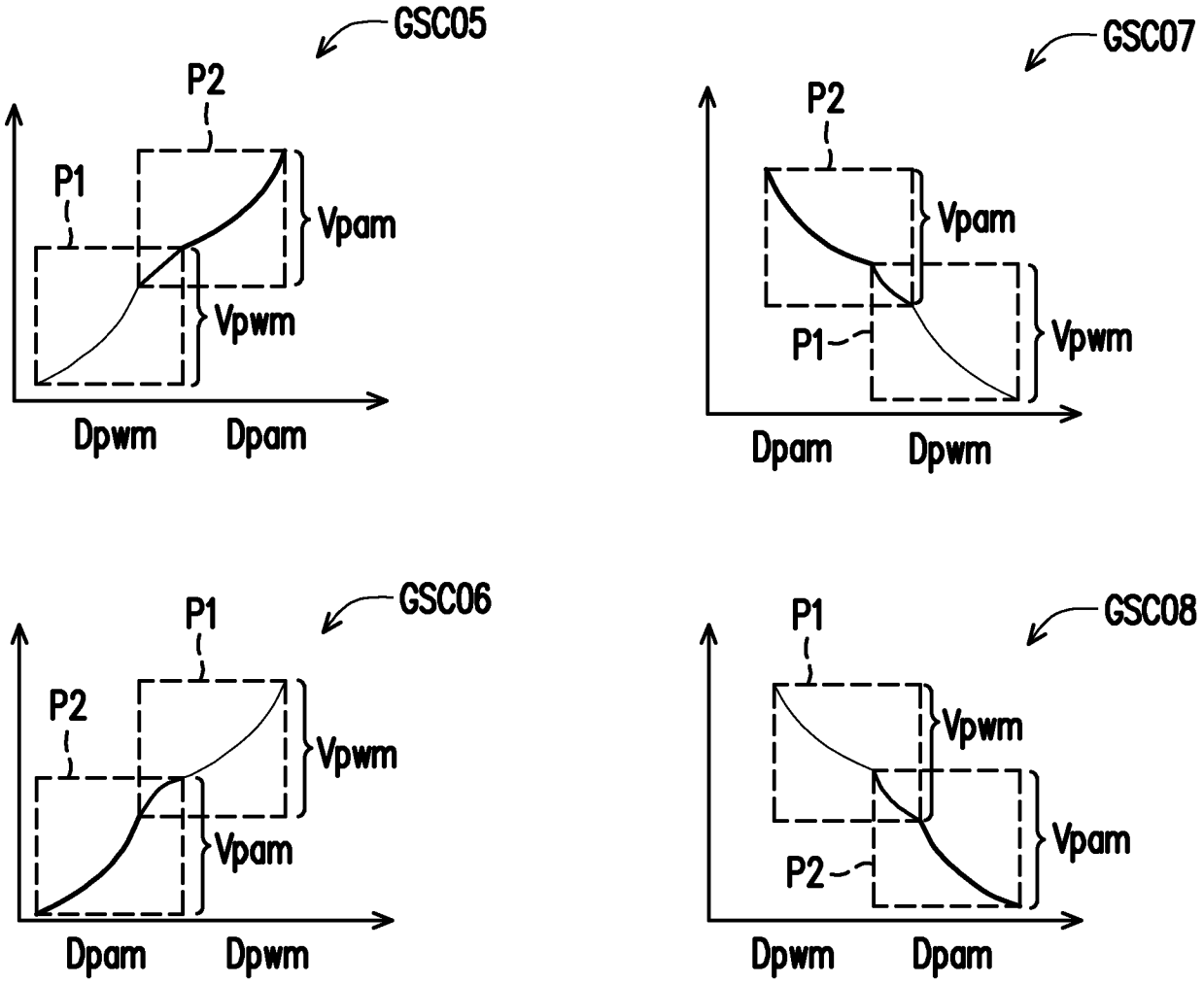
FIG. 5 illustrates gamma setting curves according to an embodiment of the disclosure.

FIG. 5 illustrates gamma setting curves according to an embodiment of the disclosure. Referring to FIG. 5, FIG. 5 shows gamma setting curves GSC05 to GSC08. Each of the gamma setting curves GSC05, GSC06, GSC07 and GSC08 includes a first part P1 and a second part P2. The first part P1 is between the first PWM data Dpwm and the second PWM data Vpwm, the second part P2 is between the first PAM data Dpam and the second PAM data Vpam. The first part P1 and the second part P2 of the gamma setting curve GSC are partially overlapped.

In the gamma setting curves GSC05, a minimum of the second PAM data Vpam is lower than a maximum of the second PWM data Vpwm. Further, a maximum of the second PAM data Vpam is higher than the maximum of the second PWM data Vpwm. The minimum of the second PAM data Vpam is higher than a minimum of the second PWM data Vpwm. Besides, the second PWM data Vpwm is positively correlated with the first PWM data Dpwm, and the second PAM data Vpam is positively correlated with the first PAM data Dpam.

In an overlapped part of the first part P1 and the second part P2, the driver 110 may provide the second PWM data Vpwm and the second PAM data Vpam based on both the first PWM data Dpwm and the first PAM data Dpam. Therefore, there is high resolution of the second PWM data Vpwm and the second PAM data Vpam in the overlapped part.

In the gamma setting curves GSC06, a minimum of the second PWM data Vpwm is lower than a maximum of the second PAM data Vpam. Further, a maximum of the second PWM data Vpwm is higher than the maximum of the second PAM data Vpam. The minimum of the second PWM data Vpwm is higher than a minimum of the second PAM data Vpam. Besides, the second PWM data Vpwm is positively correlated with the first PWM data Dpwm, and the second PAM data Vpam is positively correlated with the first PAM data Dpam.

In the gamma setting curves GSC07, a minimum of the second PAM data Vpam is lower than a maximum of the second PWM data Vpwm. Further, a maximum of the second PAM data Vpam is higher than the maximum of the second PWM data Vpwm. The minimum of the second PAM data Vpam is higher than a minimum of the second PWM data Vpwm. Besides, the second PWM data Vpwm is negatively correlated with the first PWM data Dpwm, and the second PAM data Vpam is negatively correlated with the first PAM data Dpam.

In the gamma setting curves GSC08, a minimum of the second PWM data Vpwm is lower than a maximum of the second PAM data Vpam. Further, a maximum of the second PWM data Vpwm is higher than the maximum of the second PAM data Vpam. The minimum of the second PWM data Vpwm is higher than a minimum of the second PAM data Vpam. Besides, the second PWM data Vpwm is negatively correlated with the first PWM data Dpwm, and the second PAM data Vpam is negatively correlated with the first PAM data Dpam.

Figure 6:
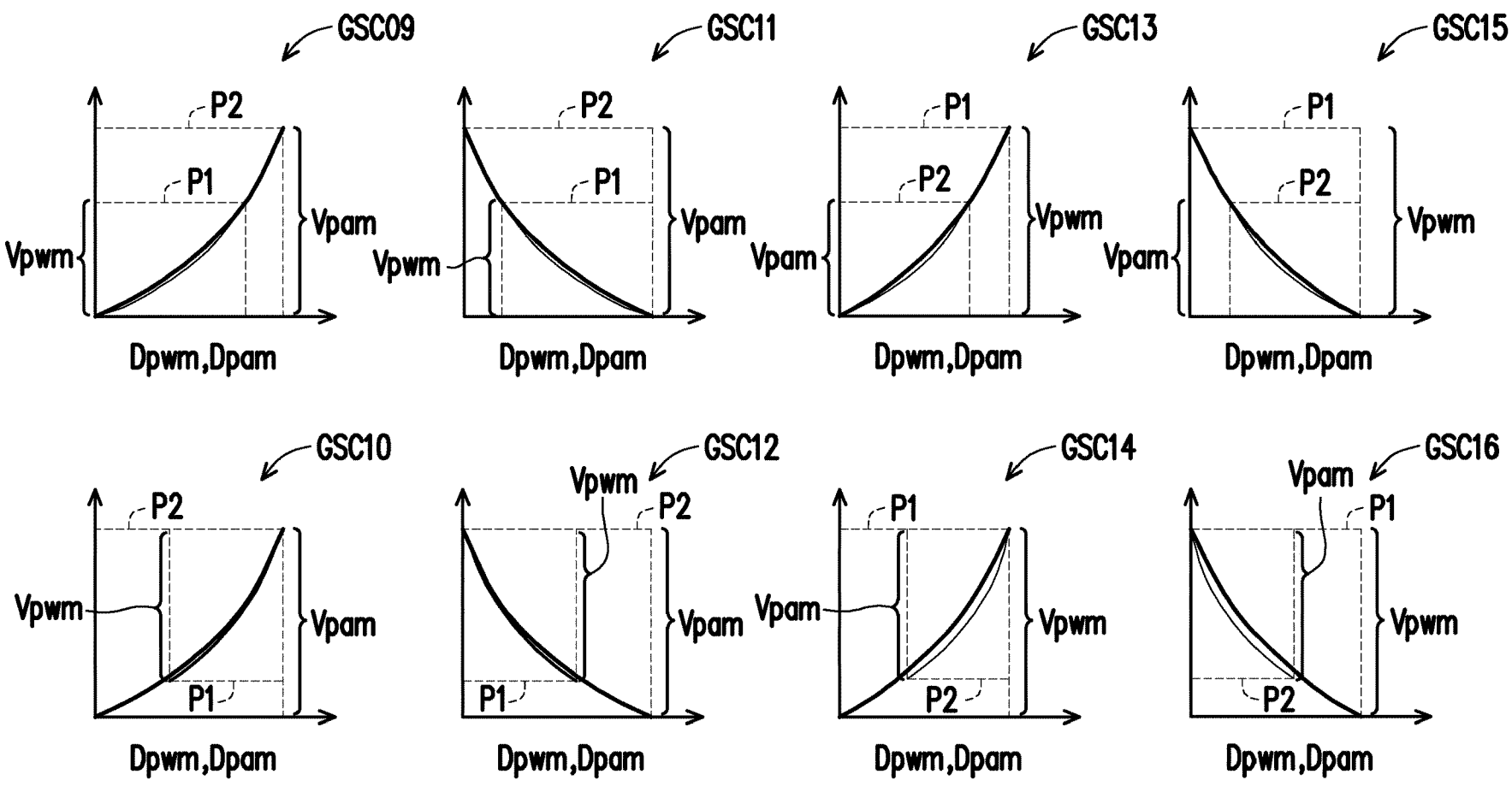
FIG. 6 illustrates gamma setting curves according to an embodiment of the disclosure.

FIG. 6 illustrates gamma setting curves according to an embodiment of the disclosure. Referring to FIG. 6, FIG. 6 shows gamma setting curves GSC09 to GSC16. Each of the gamma setting curves GSC09 to GSC16 includes a first part P1 and a second part P2. The first part P1 and the second part P2 of the gamma setting curve GSC are partially overlapped.

In the gamma setting curves GSC09, the first part P1 is in the second part P2. Further, a minimum of the second PWM data Vpwm is equal to a minimum of the second PAM data Vpam. A maximum of the second PWM data Vpwm is lower than a maximum of the second PAM data Vpam. Besides, the second PWM data Vpwm is positively correlated with the first PWM data Dpwm, and the second PAM data Vpam is positively correlated with the first PAM data Dpam.

In the gamma setting curves GSC10, the first part P1 is in the second part P2. Further, a maximum of the second PWM data Vpwm is equal to a maximum of the second PAM data Vpam. A minimum of the second PWM data Vpwm is higher than a minimum of the second PAM data Vpam. Besides, the second PWM data Vpwm is positively correlated with the first PWM data Dpwm, and the second PAM data Vpam is positively correlated with the first PAM data Dpam.

In the gamma setting curves GSC11, the first part P1 is in the second part P2. Further, a minimum of the second PWM data Vpwm is equal to a minimum of the second PAM data Vpam. A maximum of the second PWM data Vpwm is lower than a maximum of the second PAM data Vpam. Besides, the second PWM data Vpwm is negatively correlated with the first PWM data Dpwm, and the second PAM data Vpam is negatively correlated with the first PAM data Dpam.

In the gamma setting curves GSC12, the first part P1 is in the second part P2. Further, a maximum of the second PWM data Vpwm is equal to a maximum of the second PAM data Vpam. A minimum of the second PWM data Vpwm is higher than a minimum of the second PAM data Vpam. Besides, the second PWM data Vpwm is negatively correlated with the first PWM data Dpwm, and the second PAM data Vpam is negatively correlated with the first PAM data Dpam.

In the gamma setting curves GSC13, the second part P2 is in the first part P1. Further, a minimum of the second PAM data Vpam is equal to a minimum of the second PWM data Vpwm. A maximum of the second PAM data Vpam is lower than a maximum of the second PWM data Vpwm. Besides, the second PWM data Vpwm is positively correlated with the first PWM data Dpwm, and the second PAM data Vpam is positively correlated with the first PAM data Dpam.

In the gamma setting curves GSC14, the second part P2 is in the first part P1. Further, a maximum of the second PAM data Vpam is equal to a maximum of the second PWM data Vpwm. A minimum of the second PAM data Vpam is higher than a minimum of the second PWM data Vpwm. Besides, the second PWM data Vpwm is positively correlated with the first PWM data Dpwm, and the second PAM data Vpam is positively correlated with the first PAM data Dpam.

In the gamma setting curves GSC15, the second part P2 is in the first part P1. Further, a minimum of the second PAM data Vpam is equal to a minimum of the second PWM data Vpwm. A maximum of the second PAM data Vpam is lower than a maximum of the second PWM data Vpwm. Besides, the second PWM data Vpwm is negatively correlated with the first PWM data Dpwm, and the second PAM data Vpam is negatively correlated with the first PAM data Dpam.

In the gamma setting curves GSC16, the second part P2 is in the first part P1. Further, a maximum of the second PAM data Vpam is equal to a maximum of the second PWM data Vpwm. A minimum of the second PAM data Vpam is higher than a minimum of the second PWM data Vpwm. Besides, the second PWM data Vpwm is negatively correlated with the first PWM data Dpwm, and the second PAM data Vpam is negatively correlated with the first PAM data Dpam.

Figure 7:
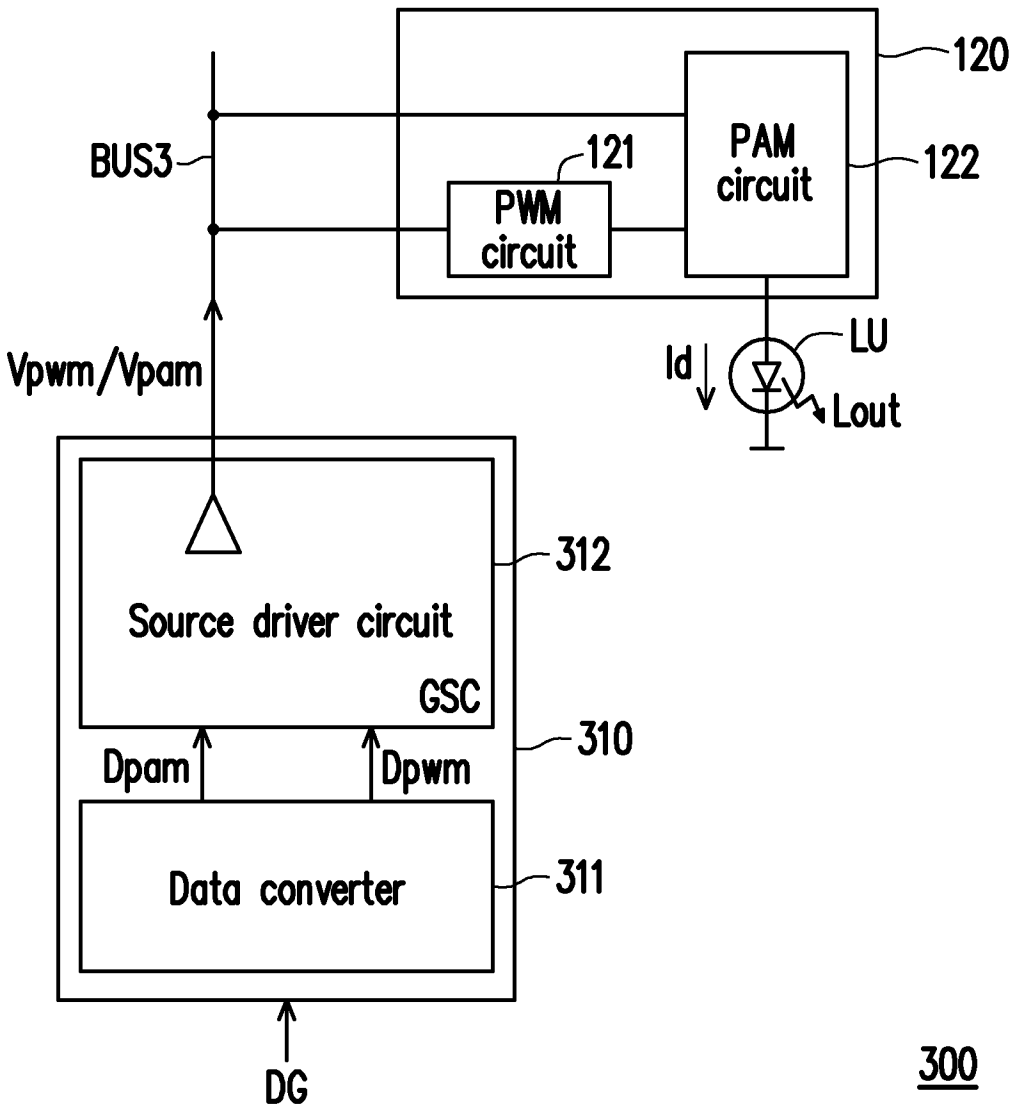
FIG. 7 illustrates a schematic diagram of an electronic device according to a third embodiment of the disclosure.

FIG. 7 illustrates a schematic diagram of an electronic device according to a third embodiment of the disclosure. Referring to FIG. 7, the electronic device 300 includes a driver 310, the driving circuit 120 and the electronic element LU. The driver 310 includes a data converter 311 and source driver circuit 312. The data converter 311 receives the gray scale data DG, and convert the gray scale data DG to the first PWM data Dpwm and the first PAM data Dpam. The source driver circuit 312 is electrically connected to the data converter 311. The source driver circuit 312 receives the first PWM data Dpwm and the first PAM data Vpwm from the data converter 311. The source driver circuit 312 converts the first PWM data Dpwm to the second PWM data Vpwm according to the gamma setting curve GSC, and convert the first PAM data Dpam to the second PAM data Vpam according to the gamma setting curve GSC. The driving circuit 120 includes a PWM circuit 121 and a PAM circuit 122.

In the embodiment, referring to FIG. 7, the source driver circuit 312 provides the second PWM data Vpwm and the second PAM data Vpam to the driving circuit 120 sequentially. In the embodiment, the driving circuit 120 is electrically connected to the driver 310 via a single data bus BUS3. The data bus BUS3 connects the driver 310, the PWM circuit 121 and the PAM circuit 122. The second PWM data Vpwm and the second PAM data Vpam are transmitted from the driver to the driving circuit 120 via the data bus BUS3. For example, the source driver circuit 312 provides the second PWM data Vpwm to the PWM circuit 121 via the data bus BUS3 at a first time, and provides the second PAM data Vpam to the PAM circuit 122 via the data bus BUS3 at a second time.

Figure 8:
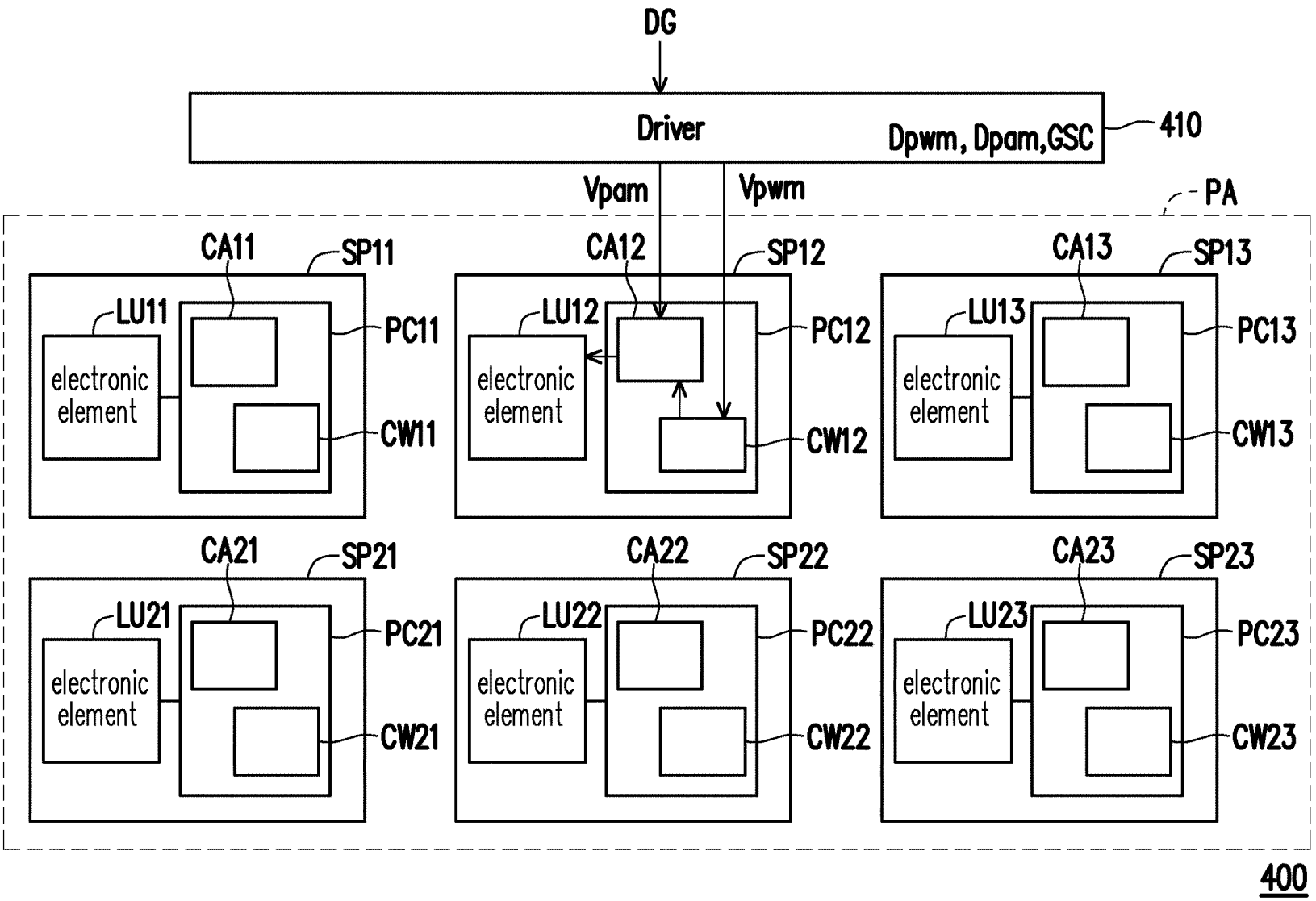
FIG. 8 illustrates a schematic diagram of an electronic device according to a fourth embodiment of the disclosure.

FIG. 8 illustrates a schematic diagram of an electronic device according to a fourth embodiment of the disclosure. Referring to FIG. 8, the electronic device 400 includes a driver 410 and a plurality of driving circuits PC11 to PC23 and electronic elements LU11 to LU23. In FIG. 8, only six driving circuits are shown for simplicity, and the number of the driving circuits can be determined according to requirement. The plurality of driving circuits can be electrically connected to the driver 410. In the embodiment, the driving circuit PC11 includes a PWM circuit CW11 and a PAM circuit CA11. The driving circuit PC12 includes a PWM circuit CW12 and a PAM circuit CA12. The driving circuit PC13 includes a PWM circuit CW13 and a PAM circuit CA13. The driving circuit PC21 includes a PWM circuit CW21 and a PAM circuit CA21. The driving circuit PC22 includes a PWM circuit CW22 and a PAM circuit CA22. The driving circuit PC23 includes a PWM circuit CW23 and a PAM circuit CA23.

In the embodiment, the driving circuit PC11 is connected between the electronic element LU11 and the driver 410. The driving circuit PC11 and the electronic element LU11 are configured as a sub-pixel unit SP11 in a display area PA. The driving circuit PC12 is connected between the electronic element LU12 and the driver 410. The driving circuit PC12 and the electronic element LU12 are configured as a sub-pixel unit SP12 in the display area PA. Other sub-pixel units SP13, SP21, SP22 and SP23 have similar design. The sub-pixel units SP11, SP12, SP13, SP21, SP22 and SP23 are arranged in a plurality of columns and a plurality of rows in the display area PA. According to some embodiments, the electronic device 400 can include a substrate (not shown), and a plurality of sub-pixel units (for example, SP11, SP12, SP13, SP21, SP22 and SP23) can be disposed on the substrate. One sub-pixel unit can include a driving circuit and an electronic element LU11. Taking the sub-pixel unit SP11 as an example, the sub-pixel unit SP11 includes the driving circuit PC11 and the electronic element LU11. The driving circuit PC11 is disposed in the sub-pixel unit SP11, and is a pixel circuit (or sub-pixel circuit).

In the embodiment, the driver 410 may be implemented by the driver 110 in FIG. 1 or the driver 210 in FIG. 2. Each of the driving circuits PC11 to PC23 may be implemented by the driving circuit 120 in FIG. 1.

The driver 410 drives the sub-pixel units SP11, SP12, SP13, SP21, SP22 and SP23 according to the gray scale data DG. For example, the driver 410 converts the gray scale data DG to the first PWM data Dpwm and the first PAM data Dpam. The driver 410 converts a first PWM data Dpwm to a second PWM data Vpwm and converts a first PAM data Dpam to a second PAM data Vpam according to the gamma setting curve. The PWM circuit CW12 receives the second PWM data Vpwm from the driver 410. The PAM circuit CA12 receives the second PAM data Vpam from the driver 410. Therefore, the driving circuit PC12 provides a driving current in response to the second PWM data Vpwm and the second PAM data Vpam. The electronic element LU12 emits a light according to the driving current provided from the driving circuit PC12.

For ease of description, the present embodiment takes six sub-pixel units SP11 to SP23 as an example. The number of sub-pixel units of the disclosure may be one or a plurality, and is not limited to the present embodiment.

In summary, in the embodiments of the disclosure, the electronic device includes the driver, the driving circuit and the electronic element. The driver converts the first PWM data to the second PWM data and converts the first PAM data to the second PAM data according to a gamma setting curve. The electronic device has a hybrid gamma setting for PAM and PWM by one driver. Therefore, the electronic device improves the optical performance by the hybrid gamma setting for PAM and PWM without significantly increasing cost.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An electronic device, comprising:

a driver, configured to convert a first pulse width modulation (PWM) data to a second PWM data according to a gamma setting curve, and convert a first pulse amplitude modulation (PAM) data to a second PAM data according to the gamma setting curve;

a driving circuit, electrically connected to the driver and comprising a PWM circuit and a PAM circuit, wherein the PWM circuit is configured to receive the second PWM data, and the PAM circuit is configured to receive the second PAM data; and an electronic element, electrically connected to the driving circuit, and configured to be driven according to a driving current provided from the driving circuit, wherein the gamma setting curve comprises a first part and a second part, the first part is a part of the gamma setting curve between the first PWM data and the second PWM data, and the second part is a part of the gamma setting curve between the first PAM data and the second PAM data.

2. The electronic device of claim 1, wherein the first PWM data is a PWM digital data, and the second PWM data is a PWM analog data.

3. The electronic device of claim 2, wherein the PWM analog data is a first control voltage outputted to the PWM circuit for controlling a width of the driving current.

4. The electronic device of claim 2, wherein a width of the driving current is controlled by the PWM circuit according to the PWM analog data.

5. The electronic device of claim 1, wherein the first PAM data is a PAM digital data, and the second PAM data is a PAM analog data.

6. The electronic device of claim 5, wherein the PAM analog data is a second control voltage outputted to the PAM circuit for controlling an amplitude of the driving current.

7. The electronic device of claim 5, wherein an amplitude of the driving current is controlled by the PAM circuit according to the PAM analog data.

8. The electronic device of claim 1, wherein the first part and the second part are partially overlapped.

9. The electronic device of claim 1, wherein the first part and the second part of the gamma setting curve are not overlapped.

10. The electronic device of claim 1, wherein the PWM circuit and the PAM circuit are electrically connected to the driver via two separate data buses.

11. The electronic device of claim 1, wherein the PWM circuit and the PAM circuit are electrically connected to the driver via a single data bus.

12. The electronic device of claim 1, wherein the driver comprises:

a data converter, configured to receive a gray scale data, and convert the gray scale data to the first PWM data and the first PAM data; and a source driver circuit, electrically connected to the data converter, and configured to receive the first PWM data and the first PAM data from the data converter, and convert the first PWM data to the second PWM data according to the gamma setting curve, and convert the first PAM data to the second PAM data according to the gamma setting curve.

13. The electronic device of claim 12, wherein the data converter converts the gray scale data to the first PWM data according to a first look-up table, and the data converter converts the gray scale data to the first PAM data according to a second look-up table.

14. The electronic device of claim 1, wherein the electronic element comprises a light emitting element, and the electronic device is a light emitting device.

15. The electronic device of claim 1, wherein the driving circuit is a pixel circuit.

16. The electronic device of claim 1, wherein the driver is configured to convert a gray scale data to the first PWM data according to a first look-up table, and to convert the gray scale data to the first PAM data according to a second look-up table.

17. The electronic device of claim 1, wherein the driver is configured to convert the first PWM data to the second PWM data according to the first part of the gamma setting curve, and to convert the first PAM data to the second PAM data according to the second part of the gamma setting curve.

* * * * *